US010507370B2

(12) United States Patent
Kroken

(10) Patent No.: US 10,507,370 B2
(45) Date of Patent: Dec. 17, 2019

(54) TRAINING EQUIPMENT COMPRISING HARNESS FOR BALL TRAINING

(71) Applicant: Geir Kroken, Vollen (NO)

(72) Inventor: Geir Kroken, Vollen (NO)

( * ) Notice: Subject to any disclaimer, the term of this patent is extended or adjusted under 35 U.S.C. 154(b) by 0 days.

(21) Appl. No.: 15/551,368

(22) PCT Filed: Feb. 25, 2016

(86) PCT No.: PCT/NO2016/050034

§ 371 (c)(1),
(2) Date: Aug. 16, 2017

(87) PCT Pub. No.: WO2016/148574

PCT Pub. Date: Sep. 22, 2016

(65) Prior Publication Data

US 2018/0028889 A1 Feb. 1, 2018

(30) Foreign Application Priority Data

Feb. 26, 2015 (NO) ..... 20150268

(51) Int. Cl.
*A63B 69/00* (2006.01)

(52) U.S. Cl.
CPC ..... *A63B 69/0086* (2013.01); *A63B 69/002* (2013.01); *A63B 2209/10* (2013.01); *A63B 2225/09* (2013.01); *A63B 2225/093* (2013.01)

(58) Field of Classification Search
CPC ..... A63B 69/0086; A63B 69/002; A63B 2209/10; A63B 2225/093
USPC ..... 473/424, 450, 458, 464, 422, 438, 446, 473/447; 482/89, 88
See application file for complete search history.

(56) References Cited

U.S. PATENT DOCUMENTS 1,049,835 A * 1/1913 Finney ..... A63B 69/26 482/88
2,400,105 A * 5/1946 Costello ..... A63B 69/20 482/88
3,030,109 A * 4/1962 Albitz ..... A63B 69/205 482/88
3,200,536 A * 8/1965 Petitto, Sr. ..... A63B 21/0608 273/DIG. 19
3,774,910 A * 11/1973 Walker, Jr. ..... A63B 67/10 273/412

(Continued)

FOREIGN PATENT DOCUMENTS

CH 203981 A 4/1939
JP 2007-82579 A 4/2007

(Continued)

OTHER PUBLICATIONS

International Search Report dated May 9, 2016 for Application No. PCT/NO2016/050034.
Espacenet English abstract of JP 2007-82579 A.

*Primary Examiner* — Mitra Aryanpour
(74) *Attorney, Agent, or Firm* — Ladas & Parry LLP; Malcolm J. MacDonald

(57) ABSTRACT

Training equipment for ball training having a ball attached to an elastic line which returns the ball to an origin, the elastic line being attached to a rod. The rod is attached to a harness arranged to be attached to the back of an athlete and is extendable, such as telescopically extendable. The rod is attached to the harness via a curved intermediate piece which may have a joint with adjustable angle.

12 Claims, 3 Drawing Sheets

(56) References Cited

U.S. PATENT DOCUMENTS 3,901,505 A * 8/1975 Gerechter ..... A63F 7/38 473/570
4,059,271 A * 11/1977 Dupre ..... A63B 21/0608 473/576
4,121,822 A * 10/1978 DiSabatino ..... A63B 69/0086 273/DIG. 19
4,247,117 A * 1/1981 Reichert ..... A63B 69/0086 473/424
5,413,328 A * 5/1995 Glancey ..... A63B 63/00 473/450
6,012,993 A * 1/2000 Guerriero ..... A63B 21/0552 473/424
6,168,539 B1 1/2001 Maina
D440,269 S * 4/2001 Thomas ..... D21/787
6,220,974 B1 4/2001 Moore
7,214,169 B1 * 5/2007 Clayton ..... A63B 21/0004 482/83
8,323,127 B2 * 12/2012 Webb ..... A63B 69/0002 473/422
2006/0229175 A1 * 10/2006 Frappier ..... A63B 21/00065 482/124
2011/0201458 A1 * 8/2011 Elder ..... A63B 43/005 473/425
2014/0228156 A1 * 8/2014 Riggle ..... A63B 69/0088 473/424
2014/0329622 A1 * 11/2014 Marshall ..... A63B 69/0086 473/424
2016/0310815 A1 * 10/2016 Anderson ..... A63B 69/0086 473/424
2018/0028889 A1 * 2/2018 Kroken ..... A63B 69/0086 473/424

FOREIGN PATENT DOCUMENTS

WO 01/58537 A1 8/2001
WO 2004/030770 A1 4/2004

* cited by examiner

TRAINING EQUIPMENT COMPRISING HARNESS FOR BALL TRAINING

The present invention concerns a training equipment of the type indicated in the preamble of claim 1.

BACKGROUND

Previously it is known that a ball attached to the elastic line may be attached to various body parts, hand, feet, waist or shoulders. Such devices are not well suited for efficient training of different exercise elements like shots, heading and ball reception where the ball is cushioned with different body parts like chest, thigh, foot and the like.

In addition numerous equipment are known for ball practising in which a ball in different ways is attached to a fixed installation via an elastic line.

From U.S. Pat. No. 6,168,539 is known to attach a football to a cord which is connected to an elastic band which in turn is attached to a handle that the user can hold. It is stated that the ball can rotate freely. The ball, however, is shown secured to the cord by means of a significant number of straps running around the ball and which will affect the ball feeling. Furthermore the need to hold the handle when performing exercises restricts the user's freedom of movement, in addition to implying a risk that the grip might slip.

U.S. Pat. No. 6,220,974 discloses a device in which a ball is suspended from a frame with cords horizontally and vertically, intended for kick training. It is stated that it shall be suitable for goalkeeper training and aerobic exercise. The framework and the way with which the ball is suspended, however, provide very limited possibilities for variation in the training.

WO publication 01/58 537 discloses a training equipment where a ball is surrounded by a net which is attached to a cord which in turn is attached either to a plate or to a vertical attachment arranged to be screwed into the ground. The equipment also includes a swivel that will allow the ball to rotate. The equipment allows more variability than the above mentioned ones, but the net that surrounds the ball is in many situations undesirable and the ground mounted equipment for tethering the ball involves a risk for injury to the users unless the equipment is used solely for kicking a ball lying at rest.

JP 2007082579 describes a device for ball training utilizing a branched suspension over a vertical elastic cord holding a ball. This system has the advantage over, for example, WO 01/58 537 that it does not include any ground-mounted equipment that athletes can injure themselves on. However, it is difficult to see that the equipment can be used for other than simple kicks on a ball at rest, albeit with the possibility of measuring the direction and the speed of the ball.

In general, and in particular in relation to football (soccer) there is a desire for ball training allowing a lot more possibilities for movement and more versatility in use.

OBJECTIVES

It is thus an object to provide a training equipment which makes individual ball training Ball, in particular soccer training, more intensive and fun.

It is a further object to provide a device which is little dependent on fixed installations or large available space.

THE PRESENT INVENTION

The above objects are achieved by the training equipment according to the present invention as defined by claim 1.

Preferred embodiments of the invention appear from the dependent claims.

It will be apparent from the following description of a detailed embodiment that the objectives of the invention are achieved.

Thus, the present invention is useful on any reasonably even surface where an athlete can move without the risk of damage. No fixed installations in the form of mountings or goals or the like are required. It is neither a problem if the site is located near an artery, near glass facades or near open water without fence there in between.

The training equipment provides 360 degrees freedom of movement, where there is an important point that the athlete at all times is positioned below the ball's suspension and the ball-path periphery.

The rod length and angle can be varied for different training situations as desired. Furthermore, the length of the elastic line can be adjusted to prevent the elastic line from undesirably coming in contact with the ground during training.

The rod angle and length prevents the player from being unduly distracted by the line, which otherwise would have been an obstacle to a natural training movement.

The training equipment is easy to bring along since it can also include a sack/bag that may quickly connect to the harness. Thus, the athlete can have a bag that accommodates the training equipment and which also, by simple manipulation, becomes a flexible training tool/equipment.

More Detailed about the Present Invention with Reference to the Drawings

Below a more thorough description of the invention in terms of exemplary embodiments is given, illustrated in the accompanying drawings, wherein.

Figure 1:
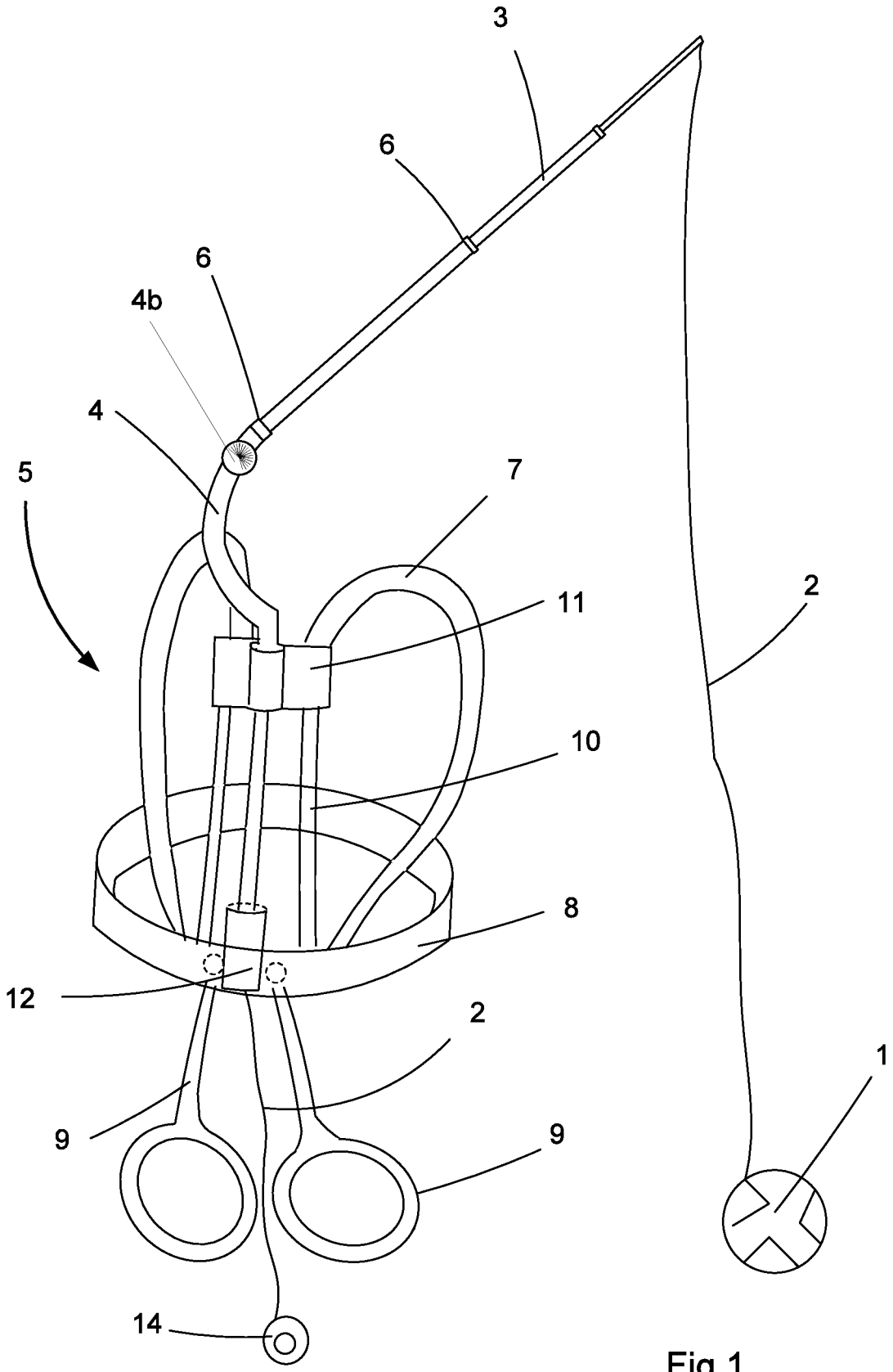
FIG. 1 shows an embodiment of the equipment according to the present invention.

FIG. 1 shows a ball 1 attached to an elastic line 2 which in turn is attached to a rod 3 which in the illustrated embodiment is extensible. It is not necessarily so that the entire line 2 is elastic, it can for example contain a non-elastic element which may have other properties, such as being lighter, stronger or less visible than the resilient part of the line. Closest to the ball, it is often desirable to have a line element which is inconspicuous and very light-weight.

The rod 3 is preferably telescopically extendable by extraction at splice sleeves 6 but may also be formed with pivotal joints or integrally formed. The line 2 may pass through the rod 3 or along the outside of the rod 3 or may just be attached to the end of the rod 3. Most preferably, the line 2 passes through the rod 2 ending in a reel 14 or the like, making it possible to consecutively adjust the line 2 length during use. The rod 3 is attached to a harness 5 adapted to be worn by an athlete in a manner similar to how a backpack is carried. To allow space for the athlete's head, the rod is attached to the harness 5 via a curved intermediate piece 4.

The curved intermediate piece 4 is preferably provided with a part 4*b* near the hinge of the rod 3 so that the angle of the rod 3 relative to the horizontal plane can be changed. The angle will naturally change dynamically with the athlete's movement, and the angles mentioned below, apply in relation to an athlete who is stationary in a natural resting position. An appropriate angle for the rod 3 when training with a ball along the ground, is in the range 30 to 50 degrees above horizontal. When training headings, the angle should be increased to approximately 60-80 degrees. As an alternative to adjustable angle of the intermediate piece 4, it may come as interchangeable intermediate pieces 4 with different degrees of curvature.

The rod 3 is typically made of a material and with a thickness allowing it to contribute to flexibility and "springiness" in the system, that is, not only the elastic line contributes to resilience and saving the ball energy when it is retarded and thereafter returned, but also the rod. In this respect the rod acts rather similarly to a fishing rod. Appropriate flexibility with respect to the ball's weight and in relation to the athlete's strength, allows the best possible user enjoyment. It is therefore appropriate that the rod 3 comes in several varieties interchangeable degrees of stiffness, flexibility.

The intermediate piece 4 should be attached to the upper fixing piece 11 in a manner in which it can not be turned from side to side, but remains stationary under the action of forces from the ball 1 through the line 2 and the rod 3.

The harness 5 typically includes shoulder straps 7, the upper ends of which being attached to an upper attachment piece 11 while the lower ends are attached to a belt 8 which in turn is secured to a lower attachment piece 12. Alternatively, the lower ends of the shoulder straps may be attached directly to the lower attachment piece 12. The lengths of the shoulder straps 7 are typically adjustable in the same way as on a rucksack. A strap X may be provided transversely between the right and left shoulder straps 7 for ensuring that the latter ones can not slip off the shoulders and to provide better attachment of the harness to the upper body of an athlete.

Upper 11 and lower attachment piece 12 are interconnected by at least one rib 10 and preferably there are plural ribs 10 connecting the upper attachment piece to the lower attachment piece 12, optionally also down to the belt 8. Multiple ribs increase stability, particularly when being arranged at some distance from one another as shown in FIG. 1.

Advantageously, the distance between the upper 11 and lower fixing piece 12 is adjustable, for example by allowing the upper attachment piece 11 to be displaceable up or down the ribs 10 and fixed at a desired position by tightening screws or other known tightening mechanism (not shown). Alternatively, the ribs 10 as such may be telescopically extendable.

Advantageously, thigh straps 9 are attached to the lower part of the harness, either as an integral unit and then typically made in a flexible material, or as a combination of e.g. elastic straps 9 attached to the lower attachment piece 12 or to the belt 8 near the lower attachment piece, and non-elastic straps or the like adapted to be attached around the athlete's thighs, etc. which is adapted to be secured around the athlete's thighs. The straps 9 may be permanently attached to the harness 5 but are preferably detachable, so that they may be replaced and so that the harness may be used without such straps. The part to be worn around the athlete's thighs are either elastic or provided with means for size adjustment, e.g. with a buckle like on a belt, like the ones used on carrying straps for cameras, or with the use of hook-and-loop type connections. When exposed for a force in an upwards direction when the ball with force moves upwards, the thigh straps 9 will prevent the harness to be pulled up above the athlete's head.

The embodiment of the straps 9 shown in FIG. 1 is in one integral piece each, resilient, without size regulation, and being adapted to be slipped on the athlete's legs from below, up to the thighs, and then to be attached to the belt 8 in allotted attachment points.

FIG. 1 furthermore shows that the line 2 is passed through the rod 3, through the intermediate piece 4, through a rib 10 down to the lower attachment piece 12 and on to a reel 14 which the athlete can hold in his hand and release more line or reel into shorter line during use as desired, depending on the type of exercise that is performed and how far away the athlete wants the ball to move before it returns. As a simpler alternative to the reel, the line can be coiled in a loop, such as when using a lasso or a fishing line during fly fishing, the user holding the loop in one hand, manually tightening or slackening as needed.

The harness 5 may further serve as a skeleton for a sack, in that for example the upper attachment piece 11 and the lower attachment piece 12, and optionally the belt 8, are provided with suitable clips, to which a bag or the like can be clipped in order for using the harness and the accompanying bag like a backpack on the way to and from training or in other contexts.

Figure 2:
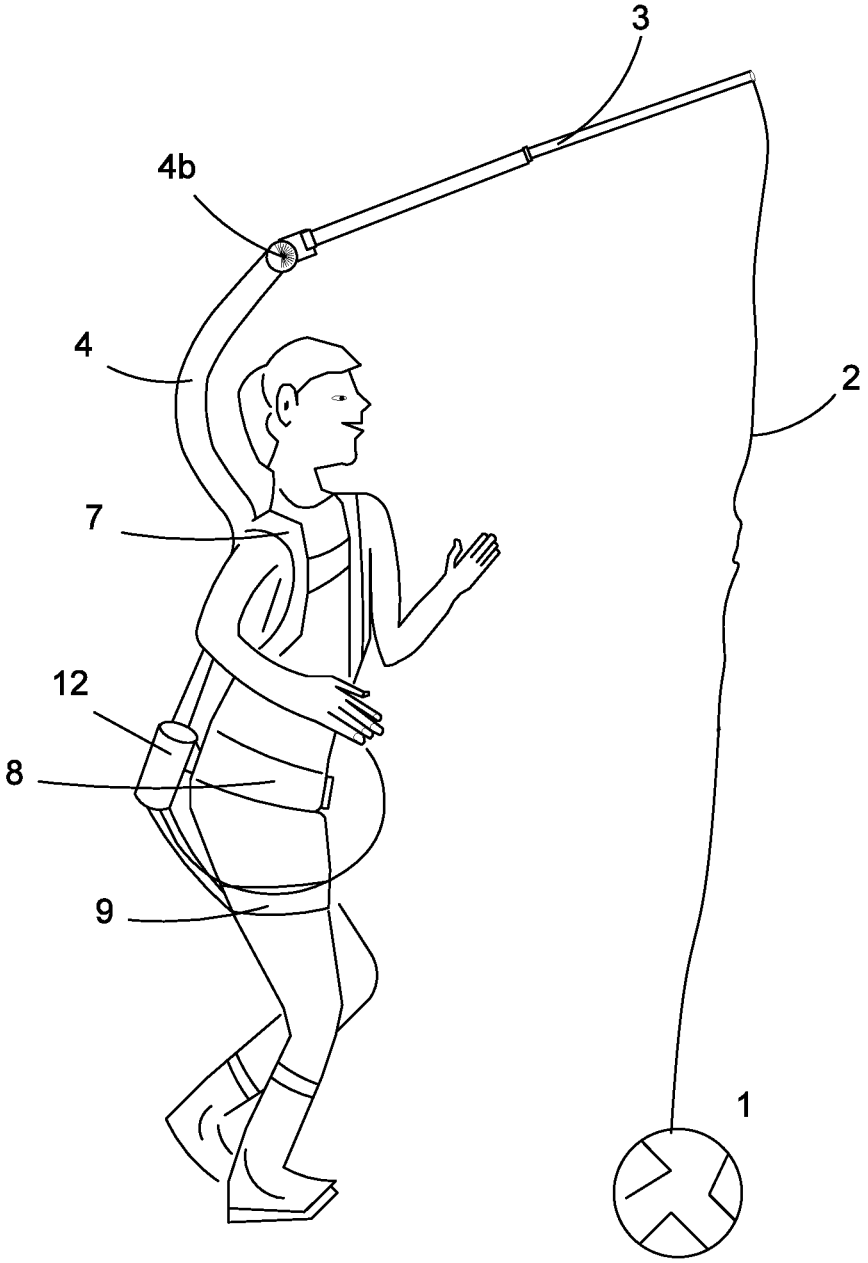
FIG. 2 is an illustration of an athlete using the equipment according to the invention.

FIG. 2 shows an athlete with equipment attached. It is disclosed how the curved intermediate piece 4 ensures that the head does not conflict with any piece of equipment. The joint **4*b*** is here set so that the equipment is well suited for training with the ball along the ground.

Figure 3:
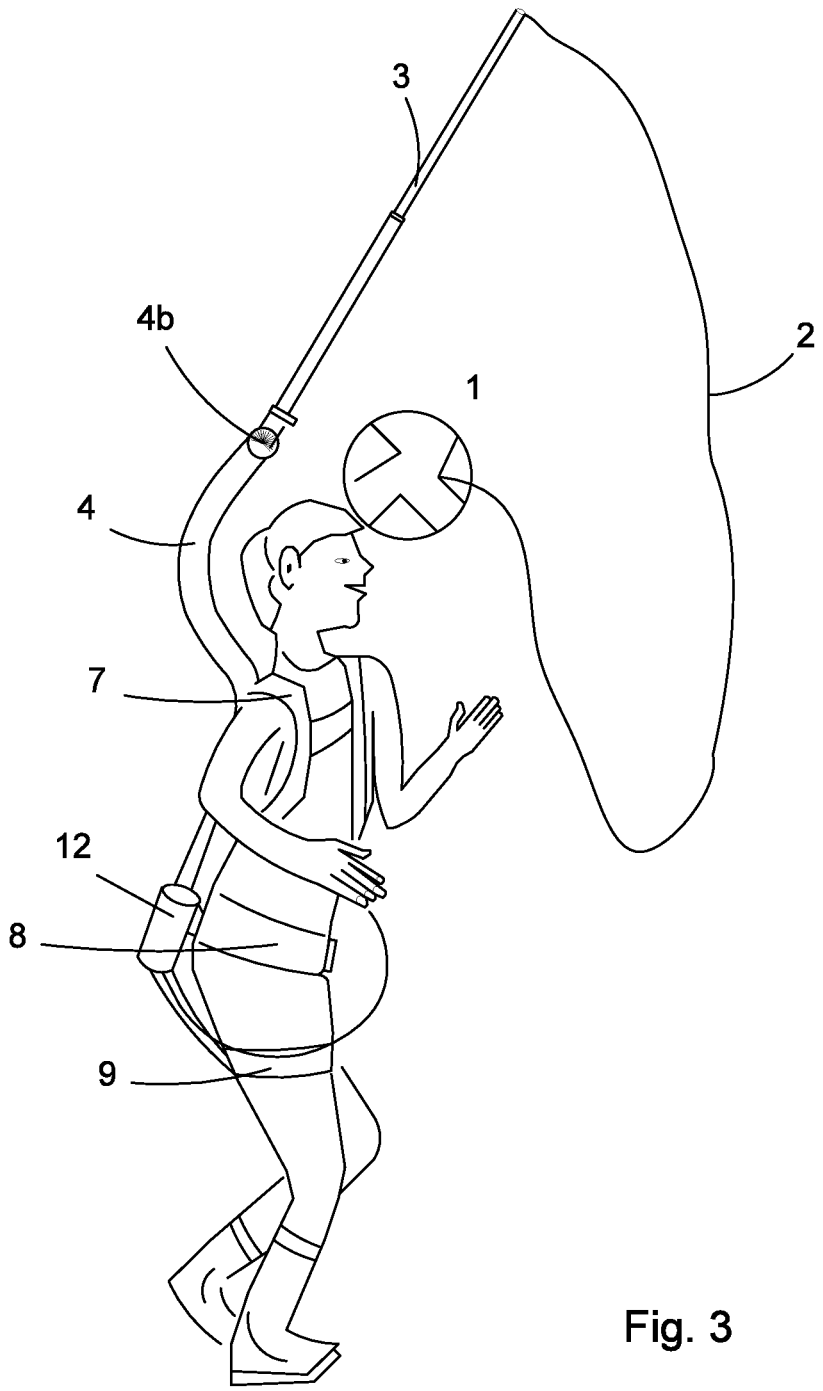
FIG. 3 is a further illustration of an athlete using the equipment of the present invention.

FIG. 3 shows in principle the same as FIG. 2, but with a setting of the joint **4*b*** more suitable for training headings.

The above illustrations are examples of the present invention as defined by the appended claims.

The invention claimed is:

1. A ball handling device utilizing a harness worn by a user, comprising:

a hollow rod having a first end and a second end;

an elastic line having a first end and a second end;

a ball;

wherein the elastic line is slidably received at the second end of the hollow rod, and the ball is attached to the second end of the elastic line;

a harness comprising an upper attachment piece and a lower attachment piece; and a hollow curved intermediate piece having a first end attached to the upper attachment piece, and a second end attached to the first end of the hollow rod;

wherein the hollow curved intermediate piece comprises an adjustable joint;

wherein the first end of the elastic line forms a loop, and wherein the length of the elastic line can be adjusted by the user.

2. The device as claimed in claim 1, wherein the rod is adjustable in length.

3. The device as claimed in claim 1, wherein the rod is telescopically extendable.

4. The device as claimed in claim 1, wherein the harness comprises a pair of shoulder straps and a belt.

5. The device as claimed in claim 4, wherein the harness further comprises a pair of thigh straps.

6. The device as claimed in claim 4, further comprising at least one rigid rib having a first end attached to the upper attachment piece, and a second end attached to the lower attachment piece.

7. The device as claimed in claim 6, wherein the upper attachment piece is arranged in connection with, or as part of, an attachment for the pair of shoulder straps.

8. The device as claimed in claim 7, wherein the lower attachment piece is attached to the belt.

9. The device as claimed in claim 6, wherein the harness comprises a belt;

wherein each of the pair of shoulder straps comprises a first end connected to the upper attachment piece, and a second end attached to the belt;

and wherein the at least one rigid rib is connected between the upper attachment piece and the lower attachment piece.

10. The device as claimed in claim 5, wherein the thigh straps are attached to the belt.

11. The device as claimed in claim 4, wherein the upper attachment piece is attached to the pair of shoulder straps.

12. The device as claimed in claim 1, wherein the upper attachment piece is disposed on the harness in a vertical plane between the lower attachment piece and the curved intermediate piece.

* * * * *